US009090070B2

(12) United States Patent
Yamamoto

(10) Patent No.: US 9,090,070 B2
(45) Date of Patent: Jul. 28, 2015

(54) MAINTENANCE APPARATUS AND INKJET RECORDING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Keizaburo Yamamoto, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/048,203

(22) Filed: Oct. 8, 2013

(65) Prior Publication Data

US 2014/0111577 A1 Apr. 24, 2014

(30) Foreign Application Priority Data

Oct. 18, 2012 (JP) ..... 2012-230642

(51) Int. Cl.
*B41J 2/015* (2006.01)
*B41J 2/165* (2006.01)
*B41J 2/21* (2006.01)

(52) U.S. Cl.
CPC ..... *B41J 2/16535* (2013.01); *B41J 2/21* (2013.01)

(58) Field of Classification Search
USPC ..... 347/33, 20
See application file for complete search history.

(56) References Cited

U.S. PATENT DOCUMENTS

| | | | | |
|---|---|---|---|---|
| 2005/0007412 | A1 | 1/2005 | Nishikawa et al. | |
| 2006/0066664 | A1 * | 3/2006 | Kachi et al. | 347/33 |
| 2009/0153615 | A1 | 6/2009 | Chikamoto et al. | |

FOREIGN PATENT DOCUMENTS

| | | |
|---|---|---|
| JP | 06-255117 | 9/1994 |
| JP | 11-300980 | 11/1999 |
| JP | 2003-011378 | 1/2003 |
| JP | 2005-022193 | 1/2005 |
| JP | 2009-143071 | 7/2009 |
| JP | 2012-153152 | 8/2012 |

OTHER PUBLICATIONS

Japanese Office Action for Japanese Patent Application No. 2012-230642 mailed Dec. 2, 2014.

* cited by examiner

*Primary Examiner* — Jason Uhlenhake
(74) *Attorney, Agent, or Firm* — Amin, Turocy & Watson, LLP

(57) ABSTRACT

According to one embodiment, there is provided a maintenance apparatus for removing ink from a nozzle surface of an inkjet head including a first region where a first nozzle is provided, a second region where a second nozzle is provided, and a third region located between the first region and the second region. The maintenance apparatus includes a first positioning section, a first wiping blade, and a second wiping blade. The first positioning section comes into contact with the third region and removes the ink present in the third region. When the first positioning section comes into contact with the third region, the first and second wiping blades come into contact with the first and second regions and remove the kinds of ink present in the first and second regions.

16 Claims, 8 Drawing Sheets

MAINTENANCE APPARATUS AND INKJET RECORDING APPARATUS

CROSS-REFERENCE TO RELATED APPLICATION

This application is based upon and claims the benefit of priority from Japanese Patent Application No. 2012-230642, filed Oct. 18, 2012, the entire contents of which are incorporated herein by reference.

FIELD

Embodiments described herein relate generally to a maintenance apparatus and an inkjet recording apparatus.

BACKGROUND

An inkjet head includes an actuator and a pressure chamber in which ink is filled. The actuator is deformed when a driving signal (voltage) is applied thereto and pressurizes the ink filled in the pressure chamber. The pressurized ink is ejected from a nozzle opened in the pressure chamber and forms an image on a printing medium such as recording paper.

The ink sometimes adheres to a nozzle surface on which the nozzle is provided. In order to prevent the ink from staining the printing medium, for example, a wiping blade removes the ink adhering to the nozzle surface.

On the other hand, there is known an inkjet head that ejects two kinds (or two colors) of ink. In the inkjet head, for example, a groove is provided between two nozzles, which eject different kinds of ink, to suppress the kinds of ink wiped by the wiping blades from being mixed between the two nozzles.

When the groove is provided between the two nozzles, it is likely that the ink wiped by the wiping blade remains in the groove. It is likely that, for example, the ink remaining in the groove stains the printing medium and affects printing quality.

DETAILED DESCRIPTION

In general, according to one embodiment, there is provided a maintenance apparatus for removing ink from a nozzle surface of an inkjet head including a first region where a first nozzle is provided, a second region where a second nozzle is provided, and a third region located between the first region and the second region. The maintenance apparatus includes a first positioning section, a first wiping blade, and a second wiping blade. The first positioning section comes into contact with the third region and removes ink present in the third region. When the first positioning section comes into contact with the third region, the first wiping blade comes into contact with the first region and removes ink present in the first region. When the first positioning section comes into contact with the third region, the second positioning section comes into contact with the second region and removes ink present in the second region.

A first embodiment is explained below with reference to FIGS. 1 to 6. Concerning components for which a plurality of expressions are possible, examples of one or more other expressions are sometimes added. This does not deny that different expressions are made concerning components not added with the other expressions and does not restrict other expressions not illustrated herein from being made.

Figure 1:
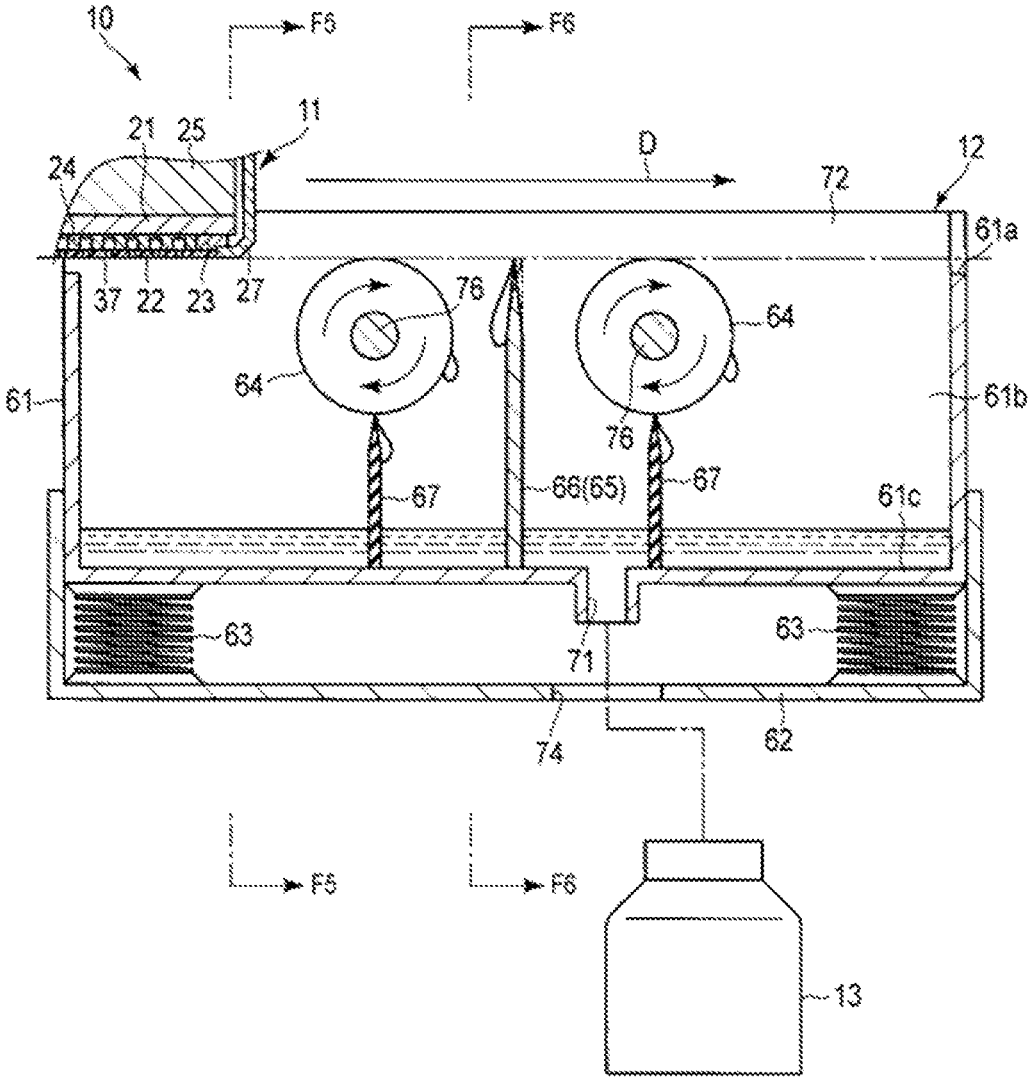
FIG. 1 is a sectional view of a part of an inkjet printer according to a first embodiment.

FIG. 1 is a sectional view of a part of an inkjet printer 10 according to the first embodiment. The inkjet printer 10 is an example of an inkjet recording apparatus. The inkjet recording apparatus is not limited to this and may be other apparatuses such as a copying machine.

As shown in FIG. 1, the inkjet printer 10 includes an inkjet head 11, a maintenance apparatus 12, and a waste liquid bottle 13. The inkjet printer 10 further includes various components such as first and second ink tanks, a circulating device, a control unit, and a recording paper supplying device. In the first and second ink tanks, different colors of ink are stored. For example, black ink is stored in the first ink tank and magenta ink is stored in the second ink tank. In the first and second ink tanks, different kinds of ink of the same color may be stored or ink of the same color and the same kind may be stored.

Figure 2:
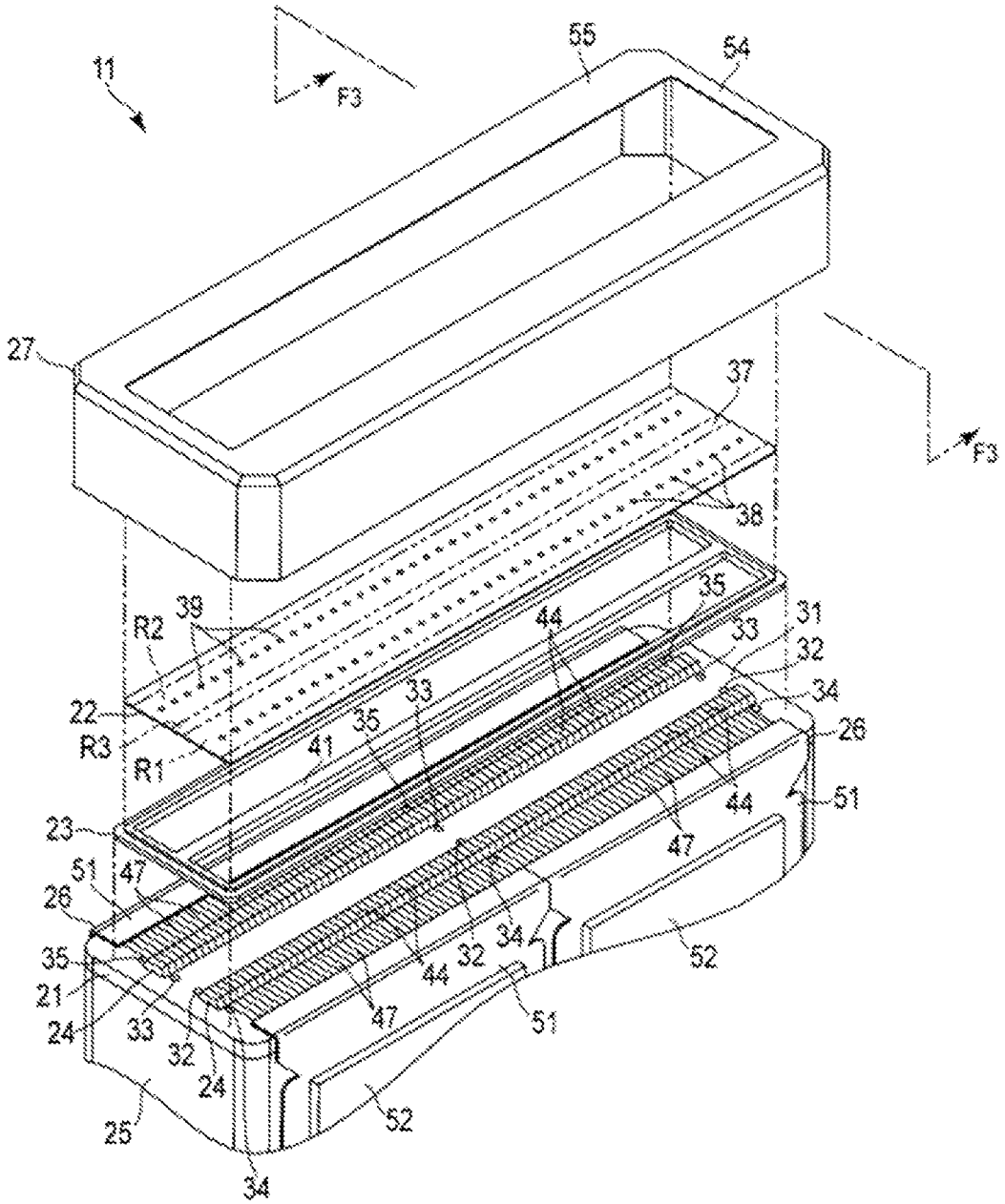
FIG. 2 is an exploded perspective view of the inkjet head.
Figure 3:
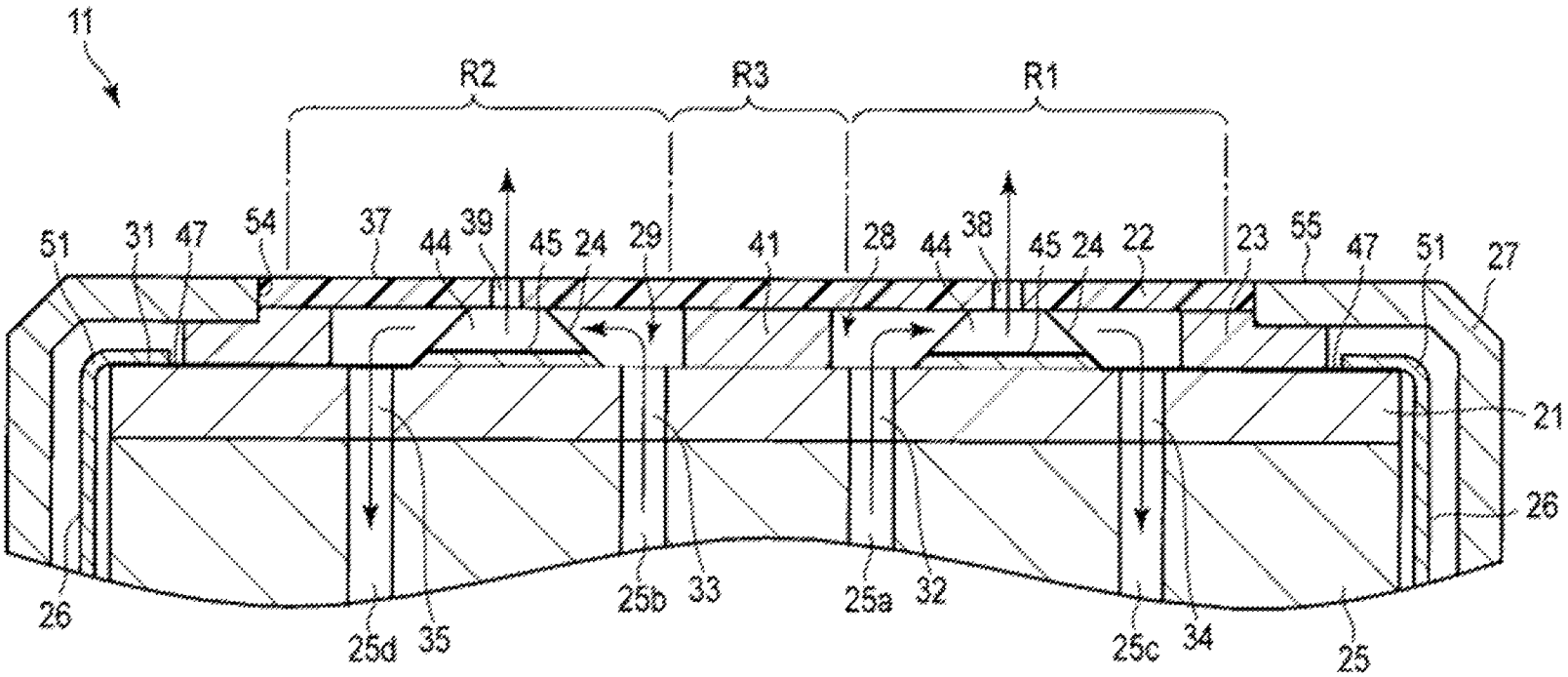
FIG. 3 is a sectional view of the inkjet head taken along line F3-F3 in FIG. 2.

FIG. 2 is a disassembled perspective view of the inkjet head 11. FIG. 3 is a sectional view of the inkjet head 11 taken along line F3-F3 in FIG. 2. As shown in FIG. 2, the inkjet head 11 is an inkjet head of a so-called side shooter type. The inkjet head 11 ejects two colors of ink to a printing medium such as recording paper and forms a character or an image on the recording medium.

The inkjet head 11 includes a base plate 21, a nozzle plate 22, a frame member 23, a pair of actuators 24, a manifold 25, a pair of circuit boards 26, and an outer frame 27. As shown in FIG. 3, a first ink chamber 28 and a second ink chamber 29, to which kinds of ink are supplied, are formed on the inside of the inkjet head 11.

As shown in FIG. 2, the base plate 21 is formed in a rectangular plate shape by ceramics such as alumina. The base plate 21 includes a flat mounting surface 31. A plurality of first supply holes 32, a plurality of second supply holes 33, a plurality of discharge holes 34, and a plurality of second discharge holes 35 are provided on the mounting surface 31.

The first and second supply holes 32 and 33 are provided side by side in two rows in the longitudinal direction of the base plate 21 in the center of the base plate 21. The row of the first supply holes 32 and the row of the second supply holes 33 are arranged in parallel to each other.

As shown in FIG. 3, the first supply holes 32 communicate with a first ink supply section 25*a* of the manifold 25. The first supply holes 32 are connected to the first ink tank via the first ink supply section 25*a*. As indicated by an arrow in FIG. 3, the ink in the first ink tank is supplied from the first supply holes 32 to the first ink chamber 28.

The second supply holes 33 communicate with a second ink supply section 25*b* of the manifold 25. The second supply holes 33 are connected to the second ink tank via the second ink supply section 25*b*. As indicated by an arrow in FIG. 3, the ink in the second ink tank is supplied from the second supply holes 33 to the second ink chamber 29.

As shown in FIG. 2, the first discharge holes 34 are arranged further on the outer side of the base plate 21 than the first supply holes 32. The second discharge holes 35 are arranged further on the outer side of the base plate 21 than the second supply holes 33.

As shown in FIG. 3, the first discharge holes 34 communicate with a first ink discharge section 25*c* of the manifold 25. The first discharge holes 34 are connected to the first ink tank via the first ink discharge section 25*c*. As indicated by an arrow in FIG. 3, the ink in the first ink chamber 28 is discharged from the first discharge holes 34 to the ink tank.

The second discharge holes 35 communicate with a second ink discharge section 25*d* of the manifold 25. The second discharge holes 35 are connected to the second ink tank via the second ink discharge section 25*d*. As indicated by an arrow in FIG. 3, the ink in the second ink chamber 29 is discharged from the second discharge holes 35 to the ink tank.

As explained above, the kinds of ink circulates between the first and second ink tanks and the first and second ink chambers 28 and 29.

As shown in FIG. 2, the nozzle plate 22 is formed by a rectangular film made of, for example, polyimide. The nozzle plate 22 is opposed to the mounting surface 31 of the base plate 21.

The nozzle plate 22 includes a flat nozzle surface 37. A plurality of first nozzles 38 and a plurality of second nozzles 39 are provided on the nozzle surface 37. The plurality of first nozzles 38 are arranged in a row along the longitudinal direction of the nozzle plate 22. The plurality of second nozzles 39 are arranged in a row in parallel to the row of the first nozzles 38.

As indicated by alternate long and two dashes lines in FIG. 2, the nozzle surface 37 includes a first region R1, a second region R2, and a third region R3. The first region R1 is a rectangular region extending in the longitudinal direction of the nozzle plate 22. The plurality of first nozzles 38 are provided in the first region R1. The second region R2 is a rectangular region extending in parallel to the first region R1. The plurality of second nozzles 39 are provided in the second region R2. The third region R3 is a rectangular region located between the first region R1 and the second region R2.

The first nozzles 38 are opposed to portions between the first supply holes 32 and the first discharge holes 34 on the mounting surface 31. The second nozzles 39 are opposed to portions between the second supply holes 33 and the second discharge holes 35 on the mounting surface 31.

The frame member 23 is formed in a rectangular frame shape by, for example, a nickel alloy. The frame member 23 is interposed between the mounting surface 31 of the base plate 21 and the nozzle plate 22. The frame member 23 is bonded to the mounting surface 31 and the nozzle plate 22.

The frame member 23 includes a partition wall 41. The partition wall 41 extends in the longitudinal direction of the base plate 21 in the center of the base plate 21. The partition wall 41 is also bonded to the mounting surface 31 and the nozzle plate 22.

As shown in FIG. 3, the partition wall 41 is arranged to correspond to the third region R3 of the nozzle surface 37. In other words, the partition wall 41 supports a portion of the nozzle plate 22 corresponding to the third region R3.

The first and second ink chambers 28 and 29 are formed to be surrounded by the base plate 21, the nozzle plate 22, and the frame member 23. The partition wall 41 partitions the first ink chamber 28 and the second ink chamber 29.

Each of the actuators 24 is formed by a pair of tabular piezoelectric bodies formed of, for example, lead zirconate titanate. The pair of piezoelectric bodies is stuck together such that polarization directions thereof are opposite to each other in the thickness direction of the piezoelectric bodies.

The actuators 24 are bonded to the mounting surface 31 of the base plate 21. The actuators 24 are bonded to the mounting surface 31 by, for example, an epoxy adhesive having a thermosetting property. The tops of the actuators 24 are bonded to the nozzle plate 22.

The pair of actuators 24 is respectively arranged in the first and second ink chambers 28 and 29 to correspond to the first and second nozzles 38 and 39. The pair of actuators 24 is arranged in parallel to each other.

The actuators 24 are formed in a trapezoidal shape in section. A plurality of pressure chambers 44 are provided in the actuators 24. The pressure chambers 44 are grooves opened in the first or second ink chamber 28 or 29.

The plurality of pressure chambers 44 extend in a direction crossing the longitudinal direction of the actuators 24 and are arranged in the longitudinal direction of the actuators 24. The plurality of pressure chambers 44 are provided to correspond to the plurality of first and second nozzles 38 and 39 of the nozzle plate 22. Therefore, each of the first or second nozzles 38 or 39 are opened in the pressure chambers 44. Pressure chambers in which the first and second nozzles 38 and 39 are not opened may be present.

As indicated by thick lines in FIG. 3, electrodes 45 are respectively provided in the plurality of pressure chambers 44. The electrodes 45 are formed by, for example, a nickel thin film. The electrodes 45 cover the inner surfaces of the pressure chambers 44.

As shown in FIG. 2, a plurality of wiring patterns 47 are provided from the mounting surface 31 of the base plate 21 to the actuators 24. The wiring patterns 47 are formed by, for example, nickel thin films. The wiring patterns 47 extend from the electrodes 45 formed in the pressure chambers 44 of the actuators 24 to side ends of the mounting surface 31.

The circuit boards 26 are film carrier packages (FCP). The circuit boards 26 include films 51 made of resin having flexibility on which a plurality of wires are formed and ICs 52 connected to the plurality of wires of the films 51. The FCP is also referred to as tape carrier package (TCP).

The films 51 are tape automated bonding (TAB). The ICs 52 are components for applying a voltage to the electrodes 45. The ICs 52 are fixed to the films 51 by, for example, resin.

Ends of the films 51 are thermocompression-bonded and connected to the wiring patterns 47 by an anisotropic conductive film (ACF). Consequently, the plurality of wires of the films 51 are electrically connected to the wiring patterns 47. Since the films 51 are connected to the wiring patterns 47, the ICs 52 are electrically connected to the electrodes 45 via the wires of the films 51.

The outer frame 27 is attached to the base plate 21 and the frame member 23 to cover the outer peripheral edges of the base plate 21, the nozzle plate 22, and the frame member 23. The outer frame 27 may be fixed to the base plate 21 and the frame member 23 by, for example, an adhesive or may be fixed to the manifold 25 or other members by, for example, screws.

As shown in FIG. 3, the outer frame 27 includes an opening section 54 and an outer surface 55. The nozzle plate 22 and a part of the frame member 23 are fit in the opening section 54. The opening section 54 is opened in the outer surface 55. The outer surface 55 is formed to be flush with the nozzle surface 37 of the nozzle plate 22. The nozzle plate 22 may project from the outer surface 55 or may be recessed with respect to the outer surface 55.

The inkjet head 11 ejects ink as explained below. As shown in FIG. 3, the kinds of ink in the first and second ink tanks are respectively supplied from the first and second supply holes 32 and 33 to the first and second ink chambers 28 and 29 through the first and second ink supply sections 25*a* and 25*b* of the manifold 25. The kinds of ink supplied to the first and second ink chambers 28 and 29 are supplied to the plurality of pressure chambers 44 of the actuators 24.

The ICs 52 apply a driving signal (voltage) to the electrodes 45 of the pressure chambers 44 via the wires of the films 51 on the basis of a signal input from the control unit. Consequently, the actuators 24 are deformed in a shear mode.

When the actuators 24 are deformed in a shear mode, the capacity of the pressure chambers 44, in which the electrodes 45 are provided, changes. Consequently, the ink in the pressure chambers 44 is pressurized and ejected from the first or second nozzles 38 or 39 corresponding to the pressure chambers 44. That is, the black ink is ejected from the first nozzles 38 and the magenta ink is ejected from the second nozzles 39.

The kinds of ink remaining without being ejected pass through the pressure chambers 44 and flow out from the first and second discharge holes 34. The kinds of ink are discharged to the first and second ink tanks through the first and second ink discharge sections 25*c* and 25*d* of the manifold 25.

Figure 4:
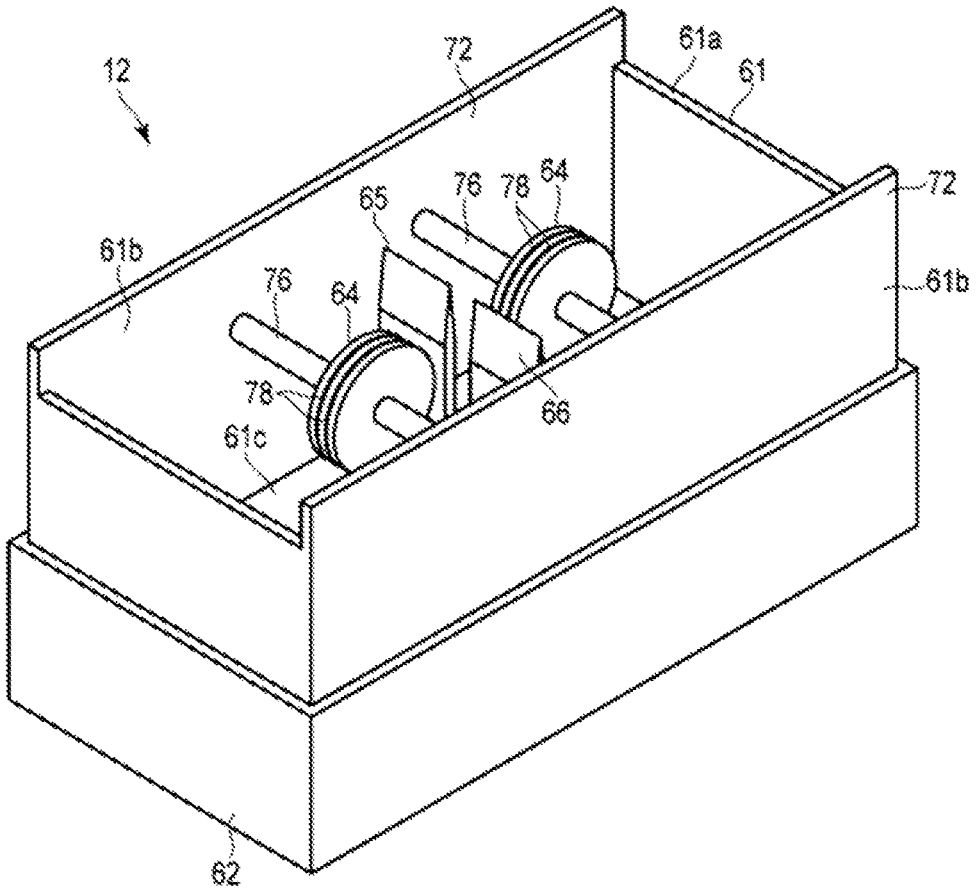
FIG. 4 is a perspective view of a maintenance apparatus according to the first embodiment.
Figure 5:
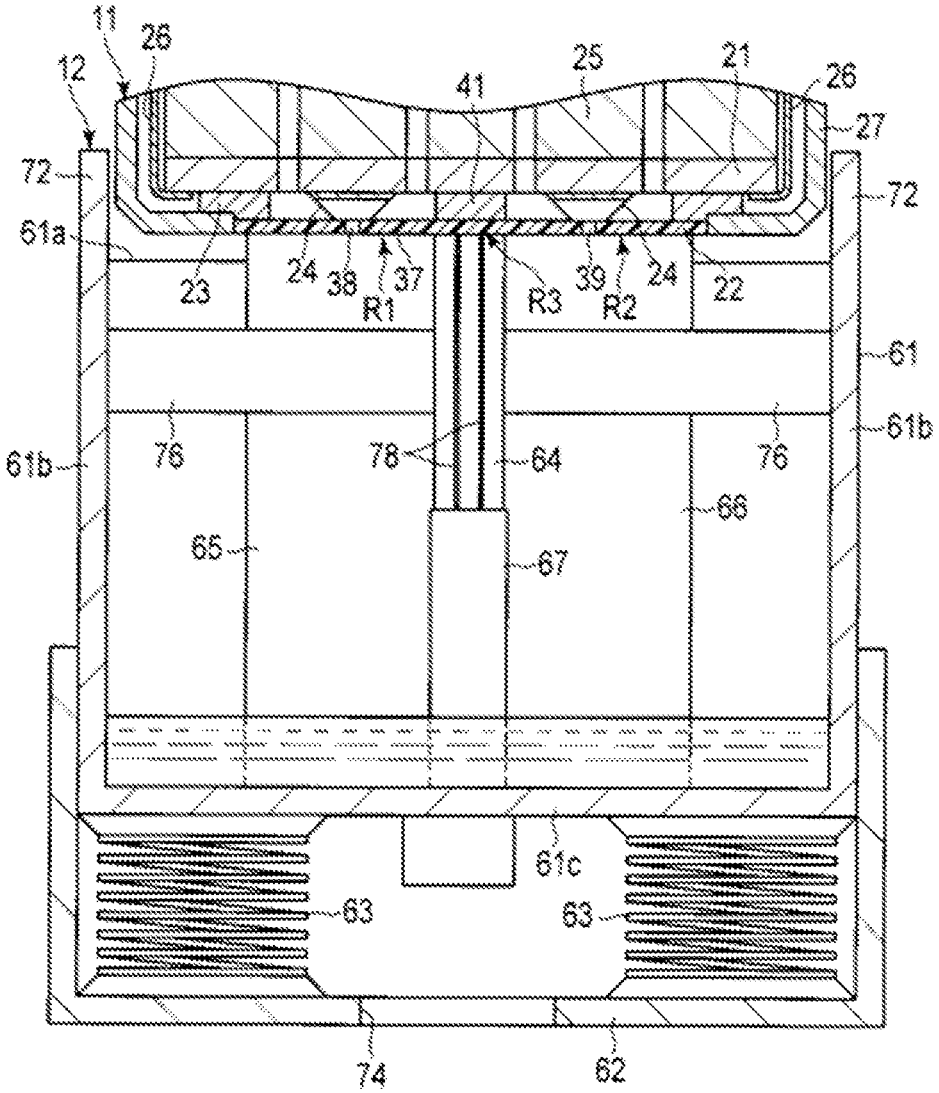
FIG. 5 is a sectional view of the inkjet head and the maintenance apparatus take along line F5-F5 in FIG. 1.

FIG. 4 is a perspective view of the maintenance apparatus 12. FIG. 5 is a sectional view of the inkjet head 11 and the maintenance apparatus 12 taken along line F5-F5 in FIG. 1. The maintenance apparatus 12 is provided to remove ink adhering to the nozzle surface 37 of the inkjet head 11.

The maintenance apparatus 12 moves in an apparatus moving direction D indicated by an arrow in FIG. 1 and removes the ink adhering to the nozzle surface 37. In other words, the apparatus moving direction D is a direction in which the maintenance apparatus 12 wipes the nozzle surface 37. The apparatus moving direction D extends along the longitudinal direction of the nozzle plate 22.

As shown in FIG. 1, the maintenance apparatus 12 includes an ink receiving section 61, a frame 62, a plurality of springs 63, a pair of rollers 64, a first wiping blade 65, a second wiping blade 66, and a pair of third wiping blades 67. The rollers 64 are an example of the first positioning section and a rotating body. The third wiping blades 67 are an example of a cleaning section and the third wiping blade.

The ink receiving section 61 is formed in a rectangular box shape and is opened at an upper end 61*a*. A discharge port 71 is opened in a bottom wall 61*c* of the ink receiving section 61. The discharge port 71 is connected to the waste liquid bottle 13 via, for example, a tube.

As shown in FIG. 5, a pair of guides 72 projects from the upper end 61*a* of the ink receiving section 61. The guides 72 are an example of a second positioning section. The guides 72 are provided integrally with sidewalls 61*b* of the ink receiving section 61 and extend in the apparatus moving direction D. The pair of guides 72 is opposed to each other. The distance between the pair of guides 72 is larger than the width of the inkjet head 11. In other words, the inkjet head 11 can be arranged between the pair of guides 72.

The frame 62 is formed in a rectangular box shape opened at an upper end and houses a lower end of the ink receiving section 61. The plurality of springs 63 are arranged between the ink receiving section 61 and the frame 62. Consequently, the ink receiving section 61 is elastically displaceable with respect to the frame 62.

The frame 62 is attached to a moving device such as an arm or a rail. The maintenance apparatus 12 is moved on the inside of the inkjet printer 10 by the moving device. The maintenance apparatus 12 moves in, for example, the apparatus moving direction D and a direction orthogonal to the nozzle surface 37.

The rollers 64 are formed by, for example, synthetic rubber excellent in ink resistance. The ink resistance indicates durability of a material immersed in ink for a fixed time. The width of the rollers 64 is smaller than the distance between the first nozzles 38 and the second nozzles 39.

The pair of rollers 64 is arranged to correspond to the third region R3 of the nozzle surface 37. The pair of rollers 64 is arranged along the longitudinal direction of the nozzle plate 22.

The pair of rollers 64 rotates around rotating shafts 76. Both ends of the rotating shaft 76 are respectively fixed to, for example, the sidewalls 61*b* of the ink receiving section 61. In other words, the rotating shaft 76 extends in a direction orthogonal to the apparatus moving direction D. The rotating shaft 76 is not limitedly attached to the sidewalls 61*b* and may be attached to other places.

As indicated by an alternate long and short dash line in FIG. 1, the tangent of the two rollers 64 extends along the apparatus moving direction D. The tangent of the two rollers 64 is present in a position higher than the upper end 61*a* of the ink receiving section 61.

As shown in FIG. 4, a plurality of grooves 78 are provided on the outer circumferential surfaces of the rollers 64. The grooves 78 are provided along the circumferential direction of the rollers 64. However, the grooves 78 may be provided along the width direction of the rollers 64.

As shown in FIG. 5, each of the first and second wiping blades 65 and 66 projects from the bottom wall 61*c* of the ink receiving section 61. The first and second wiping blades 65 and 66 are formed by, for example, synthetic rubber excellent in ink resistance.

The first wiping blade 65 is arranged to correspond to the first region R1 of the nozzle surface 37. The second wiping blade 66 is arranged to correspond to the second region R2 of the nozzle surface 37 and arranged side by side with the first wiping blade 65.

As shown in FIG. 1, the first and second wiping blades 65 and 66 are arranged between the pair of rollers 64 in the apparatus moving direction D. The first and second wiping blades 65 and 66 may be arranged in other places.

The distance between the first and second wiping blades 65 and 66 is equal to the width of the rollers 64. The distance between the first and second wiping blades 65 and 66 may be smaller than or may be larger than the width of the rollers 64.

As shown in FIG. 1, the distal ends of the first and second wiping blades 65 and 66 are located on the tangent of the pair of rollers 64. The distal ends of the first and second wiping blades 65 and 66 may project from the tangent of the pair of rollers 64.

Each of the pair of third wiping blades 67 projects from the bottom wall 61*c* of the ink receiving section 61. The third wiping blades 67 are formed by, for example, synthetic rubber excellent in ink resistance.

The pair of third wiping blades 67 is arranged to correspond to the pair of rollers 64. The distal ends of the third wiping blades 67 are in contact with the outer circumferential surfaces of the rollers 64. Therefore, when the rollers 64 rotate, the third wiping blades 67 wipe the outer circumferential surfaces of the rollers 64.

For example, the maintenance apparatus 12 removes ink adhering to the nozzle surface 37 as explained below.

First, the maintenance apparatus 12 is moved to under the inkjet head 11 by the moving device. The maintenance apparatus 12 is brought close to the inkjet head 11 by the moving device to enter between the pair of guides 72. Consequently, as shown in FIG. 5, the inkjet head 11 is arranged between the pair of guides 72 and the pair of rollers 64 comes into contact with the third region R3 of the nozzle surface 37. In this way, the pair of guides 72 is used for alignment in the width direction of the inkjet head 11 and the maintenance apparatus 12. The rollers 64 may partially come into contact with the first and second regions R1 and R2. Only one roller 64 may come into contact with the third region R3.

When the rollers 64 come into contact with the third region R3, the first wiping blade 65 comes into contact with the first region R1 of the nozzle surface 37. Further, the second wiping blade 66 comes into contact with the second region R2. In this way, the pair of rollers 64 is used for the alignment in the thickness direction of the inkjet head 11 and the maintenance apparatus 12. The first and second wiping blades 65 and 66 may partially come into contact with the third region R3.

When the first and second wiping blades 65 and 66 come into contact with the nozzle surface 37, the force of the first wiping blade 65 coming into contact with the first region R1 of the nozzle surface 37 (a bending amount of the first wiping blade 65) and the force of the second wiping blade 66 coming into contact with the second region R2 (a bending amount of the second wiping blade 66) are regulated from increasing to be equal to or larger than a predetermined value. That is, since the pair of rollers 64 comes into contact with the third region R3 of the nozzle surface 37, the first and second wiping blades 65 and 66 are prevented from excessively pressing the first and second regions R1 and R2. Further, the plurality of springs 63 are elastically deformed to reduce the forces of first and second wiping blades 65 and 66 coming into contact with the first and second regions R1 and R2.

As shown in FIG. 1, in a state in which the rollers 64 and the first and second wiping blades 65 and 66 are in contact with the nozzle surface 37, the moving device moves the maintenance apparatus 12 in the apparatus moving direction D. Consequently, the first wiping blade 65 scrapes and removes the ink present in the first region R1. Further, the second wiping blade 66 scrapes and removes the ink present in the second region R2. At this point, as indicated by an alternate long and two dashes line in FIG. 1, the first and second wiping blades 65 and 66 may bend. The scraped ink drips to the inside of the ink receiving section 61 from the first and second wiping blades 65 and 66.

Figure 6:
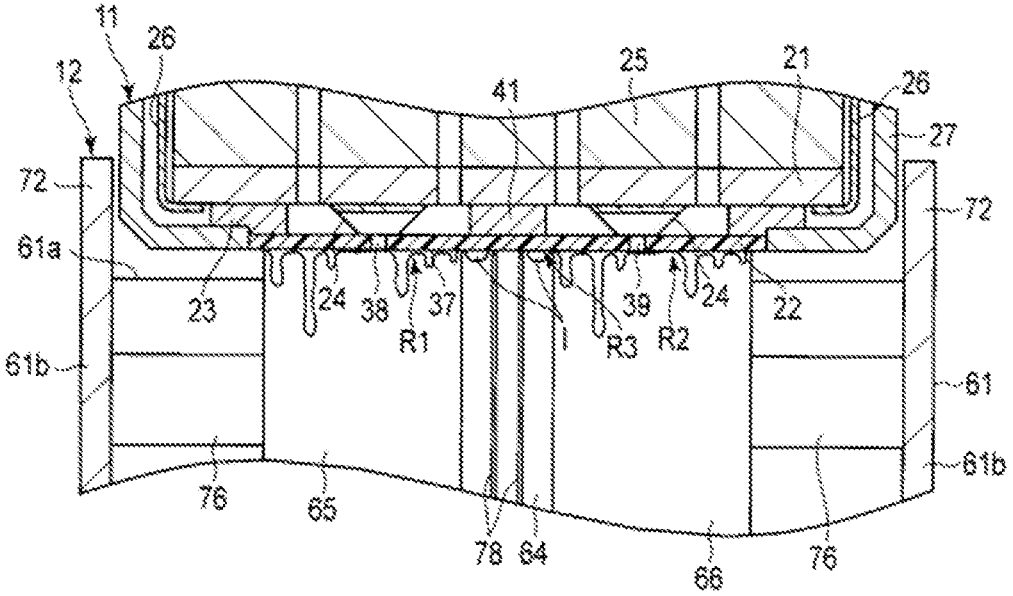
FIG. 6 is a sectional view of a part of the inkjet head and the maintenance apparatus taken along line F6-F6 in FIG. 1.

FIG. 6 is a sectional view of a part of the inkjet head 11 and the maintenance apparatus 12 taken along line F6-F6 in FIG. 1. As shown in FIG. 6, parts I of the kinds of ink scraped by the first and second wiping blades 65 and 66 are moved aside to the center of the nozzle surface 37. In other words, the parts I of the kinds of ink adhering to the first and second regions R1 and R2 move to the third region R3.

After the first and second wiping blades 65 and 66 remove the kinds of ink adhering to the first and second regions R1 and R2, the rollers 64 rotationally move in the third region R3. The rollers 64 remove the ink adhering to the third region R3 and the parts I of the kinds of ink moved from the first and second regions R1 and R2. The kinds of ink adhere to the outer circumferential surfaces of the rollers 64 and further intrudes into the grooves 78 of the rollers 64.

As shown in FIG. 1, the ink removed by the rollers 64 drips to the inside of the ink receiving section 61 according to the rotation of the rollers 64. Further, the ink adhering to the outer circumferential surfaces of the rollers 64 is scraped and removed by the third wiping blades 67. The scraped ink drips to the inside of the ink receiving section 61 from the third wiping blades 67.

As explained above, the ink receiving section 61 receives the kinds of ink removed by the pair of rollers 64 and the first and second wiping blades 65 and 66. The ink is discharged from the discharge port 71 of the ink receiving section 61 to the waste liquid bottle 13.

The maintenance apparatus 12 moves a plurality of times in the apparatus moving direction D and the opposite direction of the apparatus moving direction D. When the maintenance apparatus 12 moves in the opposite direction of the apparatus moving direction D, the maintenance apparatus 12 also removes the ink adhering to the nozzle surface 37. Consequently, the ink is removed from the nozzle surface 37. After the ink is removed, the moving device moves the maintenance apparatus 12 away from the inkjet head 11 and arranges the maintenance apparatus 12 in a predetermined position.

In the inkjet printer 10 according to the first embodiment, the rollers 64 perform the alignment in the thickness direction of the inkjet head 11 and the first and second wiping blades 65 and 66. The rollers 64 remove the ink present in the third region R3 of the nozzle surface 37. Consequently, it is possible to suppress the ink from remaining in the third region R3 and suppress the two colors of ink from being mixed. It is possible to suppress excess ink accumulated in the third region R3 from adhering to a printing medium such as recording paper. Further, it is possible to suppress the first and second wiping blades 65 and 66 from excessively moving toward the nozzle surface 37 and damaging the nozzle surface 37.

As shown in FIG. 5, a portion of the nozzle plate 22 corresponding to the third region R3 is supported by the partition wall 41. Consequently, the force of the rollers 64 coming into contact with the third region R3 is received by the partition wall 41. It is possible to suppress the force from damaging the nozzle plate 22.

The rollers 64 come into contact with the nozzle surface 37 to regulate the forces of the first and second wiping blades 65 and 66 coming into contact with the nozzle surface 37. Consequently, it is possible to suppress the first and second wiping blades 65 and 66 from excessively pressing and damaging the nozzle surface 37.

The rollers 64 can rotationally move in the apparatus moving direction D on the third region R3. Consequently, even if the rollers 64 come into contact with the nozzle surface 37, the maintenance apparatus 12 can smoothly move in the apparatus moving direction D.

The plurality of grooves 78 are provided on the outer circumferential surfaces of the rollers 64. Therefore, the ink adhering to the third region R3 is absorbed in the grooves 78 by the capillary effect. Consequently, it is possible to efficiently remove the ink present in the third region R3.

The third wiping blades 67 remove the ink present on the outer circumferential surfaces of the rollers 64. Consequently, it is possible to suppress the ink removed by the rollers 64 from remaining on the outer circumferential surfaces of the rollers 64 and adhering to the third region R3 again.

When the first and second wiping blades 65 and 66 come into contact with the first and second regions R1 and R2 and the rollers 64 come into contact with the third region R3, the inkjet head 11 is arranged between the two guides 72. In other words, the pair of guides 72 performs the alignment in the width direction of the inkjet head 11 and the maintenance apparatus 12. Consequently, it is possible to, for example, suppress the rollers 64 from coming into contact with the first or second region R1 or R2 and suppress the nozzle surface 37 from being damaged.

The pair of guides 72 is provided in the ink receiving section 61. Consequently, it is possible to suppress increases in material costs and work processes due to provision of the guides 72.

The springs 63 reduce the force of the rollers 64 coming into contact with the third region R3. Consequently, it is possible to suppress the pair of rollers 64 and the first and second wiping blades 65 and 66 from excessively pressing the nozzle surface 37.

A second embodiment is explained with reference to FIG. 7. In at least one embodiment disclosed below, components having the same functions as the inkjet printer 10 according to the first embodiment are denoted by the same reference numerals and signs. Further, explanation concerning the components is sometimes partly or entirely omitted.

Figure 7:
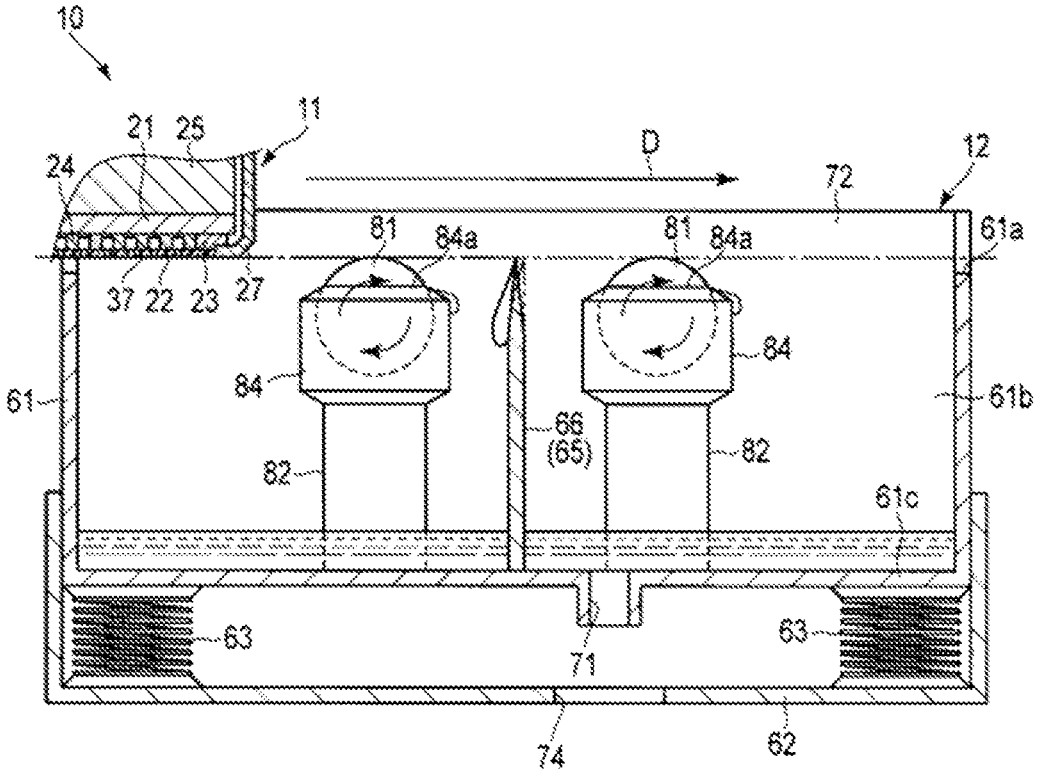
FIG. 7 is a sectional view of an inkjet head and a maintenance apparatus according to a second embodiment.

FIG. 7 is a sectional view of the inkjet head 11 and the maintenance apparatus 12 according to the second embodiment. As shown in FIG. 7, the maintenance apparatus 12 according to the second embodiment includes a pair of balls 81 and a pair of supporting bodies 82 instead of the rollers 64 and the third wiping blades 67. The balls 81 are an example of the first positioning section and the rotating body. The pair of supporting bodies 82 is an example of the cleaning section.

The supporting bodies 82 project from the bottom surface 61*c* of the ink receiving section 61. Housing sections 84 are provided in the supporting bodies 82. Upper ends 84*a* of the housing sections 84 are opened. The balls 81 are rotatably housed in the housing sections 84. A part of the balls 81 projects from the opened upper ends 84*a* of the housing sections 84. The edges of the upper ends 84*a* are in contact with the outer circumferential surfaces of the balls 81.

The balls 81 are formed by, for example, synthetic rubber excellent in ink resistance. The pair of balls 81 is arranged to correspond to the third region R3 of the nozzle surface 37. The pair of balls 81 is arranged along the longitudinal direction of the nozzle plate 22.

As indicated by an alternate long and short dash line in FIG. 7, the tangent of the two balls 81 extends along the apparatus moving direction D. The tangent of the two balls 81 is present in a position higher than the upper end 61*a* of the ink receiving section 61.

Like the rollers 64 in the first embodiment, the balls 81 come into contact with the third region R3 of the nozzle surface 37. The pair of balls 81 is used for the alignment in the thickness direction of the inkjet head 11 and the maintenance apparatus 12.

When the maintenance apparatus 12 moves in the apparatus moving direction D, after the first and second wiping blades 65 and 66 remove kinds of ink adhering to the first and second regions R1 and R2, the balls 81 rotationally move in the third region R3. The balls 81 remove ink adhering to the third region R3 and the parts I of the kinds of ink moved from the first and second regions R1 and R2.

As shown in FIG. 7, the ink removed by the balls 81 is scraped and removed by the edges of the upper ends 84*a* of the housing sections 84. The scraped ink drips to the inside of the ink receiving section 61 from the supporting bodies 82.

As explained in the second embodiment above, the rotating body is not limited to the rollers 64 and may be the balls 81 and other components. Further, the first positioning section is not limited to the rotating body and may be, for example, other components such as a column having a low coefficient of friction in a portion in contact with the nozzle surface 37.

Figure 8:
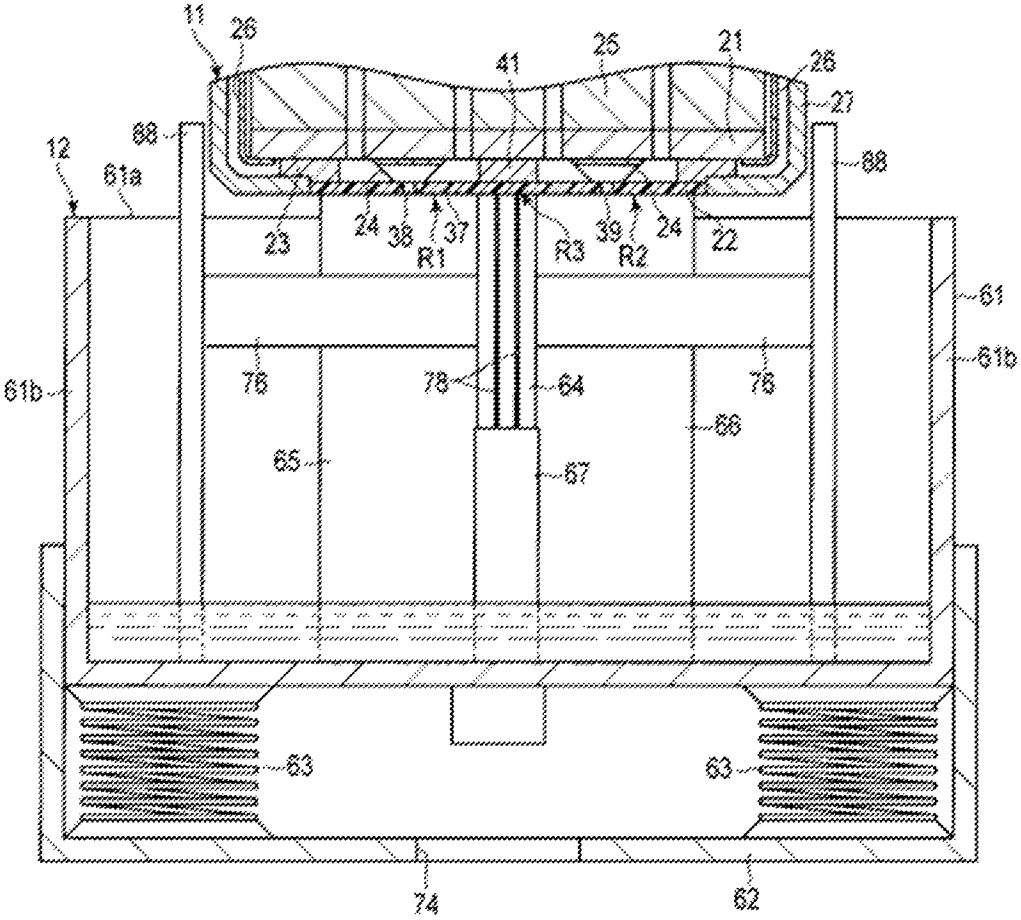
FIG. 8 is a sectional view of a part of an inkjet head and a maintenance apparatus according to a third embodiment.

A third embodiment is explained with reference to FIG. 8. FIG. 8 is a sectional view of a part of the inkjet head 11 and the maintenance apparatus 12 according to the third embodiment. As shown in FIG. 8, the inkjet head 11 according to the third embodiment includes a pair of guides 88. The guides 88 are an example of the second positioning section.

The guides 88 are formed in a tabular shape projecting from the bottom wall 61*c* of the ink receiving section 61. The guides 88 extend along the apparatus moving direction D. The pair of guides 88 is opposed to each other. The distance between the pair of guides 88 is larger than the width of the inkjet head 11.

The pair of rollers 64 is arranged between the pair of guides 88. Both ends of the rotating shaft 76 are fixed to the guides 88. The rotating shaft 76 may be fixed to the sidewalls 61*b* of the inkjet section 61.

As explained in the third embodiment above, the second positioning section is not limited to the guides 72 provided in the ink receiving section 61 and may be other members such as the tabular guides 88 and rollers that come into contact with the side surfaces of the inkjet head 11.

In at least one of the maintenance apparatuses explained above, when the first positioning section comes into contact with the third region of the nozzle surface, the first and second wiping blades come into contact with the first and second regions of the nozzle surface. The first and second wiping blades remove kinds of ink present in the first and second regions and the first positioning section removes ink present in the third region. Consequently, it is possible to suppress the ink from remaining on the nozzle surface.

As anther example, a base of the first wiping blade 65 and a base of the second wiping blade 66 may be connected. In other words, the first and second wiping blades 65 and 66 may be integrally formed. When the inkjet head 11 moves, the maintenance apparatus 12 may remove the ink present on the nozzle surface 37. Grooves that engage with the rollers 64 may be provided in the nozzle plate 22.

While the several embodiments have been explained, these embodiments have been presented by way of example only, and are not intended to limit the scope of the inventions. Indeed, the novel embodiments described herein may be embodied in a variety of other forms; furthermore, various omissions, substitutions, and changes in the form of the embodiments described herein may be made without departing from the spirit of the inventions. The accompanying claims and their equivalents are intended to cover such forms or modifications as would fall within the scope and spirit of the inventions.

What is claimed is:

1. A maintenance apparatus for removing ink from a nozzle surface of an inkjet head including a first region where a first nozzle is provided, a second region where a second nozzle is provided, and a third region located between the first region and the second region, the maintenance apparatus comprising:

a first positioning section configured to come into contact with the third region and remove ink present in the third region;

a first wiping blade configured to, when the first positioning section comes into contact with the third region, come into contact with the first region and remove ink present in the first region; and a second wiping blade configured to, when the first positioning section comes into contact with the third region, come into contact with the second region and remove ink present in the second region, wherein the first positioning section comes into contact with the nozzle surface to regulate a force of the first wiping blade coming into contact with the first region from increasing to be equal to or larger than a predetermined value and regulate a force of the second wiping blade coming into contact with the second region from increasing to be equal to or larger than a predetermined value.

2. The apparatus according to claim 1, wherein the first positioning section includes a rotating body configured rotatably come into contact with the third region.

3. The apparatus according to claim 2, wherein a groove is provided on an outer circumferential surface of the rotating body.

4. The apparatus according to claim 3, further comprising a cleaning section configured to remove the ink present on the outer circumferential surface of the rotating body.

5. The apparatus according to claim 4, wherein the cleaning section includes a third wiping blade configured to remove the ink present on the outer circumferential surface of the rotating body.

6. The apparatus according to claim 5, further comprising a pair of second positioning sections, wherein when the first wiping blade comes into contact with the first region, the second wiping blade comes into contact with the second region, and the first positioning section comes into contact with the third region, the inkjet head is arranged between the pair of second positioning sections.

7. The apparatus according to claim 6, further comprising an ink receiving section configured to receive the kinds of ink removed by the first positioning section and the first and second wiping blades and including the pair of second positioning sections.

8. The apparatus according to claim 7, further comprising a spring for reducing the force of the first positioning section coming into contact with the third region.

9. An inkjet recording apparatus comprising:

an inkjet head; and a maintenance apparatus for removing ink from a nozzle surface of the inkjet head including a first region where a first nozzle is provided, a second region where a second nozzle is provided, and a third region located between the first region and the second region, the maintenance apparatus comprising:

a first positioning section configured to come into contact with the third region and remove ink present in the third region;

a first wiping blade configured to, when the first positioning section comes into contact with the third region, come into contact with the first region and remove ink present in the first region; and a second wiping blade configured to, when the first positioning section comes into contact with the third region, come into contact with the second region and remove ink present in the second region, wherein the first positioning section comes into contact with the nozzle surface to regulate a force of the first wiping blade coming into contact with the first region from increasing to be equal to or larger than a predetermined value and regulate a force of the second wiping blade coming into contact with the second region from increasing to be equal to or larger than a predetermined value.

10. An inkjet recording apparatus comprising:

an inkjet head comprising a nozzle surface including a first region having a first nozzle to discharge first ink, a second region having a second nozzle to discharge second ink different in type or color from the first ink, and a third region between the first region and the second region;

a roller comprising a plurality of circumferentially-formed grooves on an outer circumferential surface, the roller configured to contact the third region to remove the first or second ink in the third region and used for positioning in a thickness direction with respect to the inkjet head;

a first wiping blade configured to contact the first region when the roller contacts the third region, and to remove the first ink in the first region; and a second wiping blade configured to contact the second region when the roller contacts the third region, and to remove the second ink in the second region.

11. The apparatus according to claim 10, wherein the roller is configured to contact the nozzle surface to regulate a force of the first wiping blade contacting the first region from increasing to be equal to or larger than a predetermined value and regulate a force of the second wiping blade contacting the second region from increasing to be equal to or larger than a predetermined value.

12. The apparatus according to claim 10, further comprising a third wiping blade configured to remove ink on the outer circumferential surface of the roller.

13. The apparatus according to claim 12, further comprising a pair of positioning sections, wherein the inkjet head is between the pair of positioning sections when the first wiping blade contacts the first region, the second wiping blade contacts the second region, and the roller contacts the third region.

14. The apparatus according to claim 13, further comprising an ink receiving section configured to receive the ink removed by the roller and the first and second wiping blades, the ink receiving section comprising the pair of positioning sections.

15. The apparatus according to claim 14, further comprising a spring for reducing a force of the roller contacting the third region.

16. The apparatus according to claim 10, wherein an upper end of the roller and upper ends of the first and second wiping blades are co-located in the thickness direction.

* * * * *